US010939754B2

(12) United States Patent
Allen

(10) Patent No.: US 10,939,754 B2
(45) Date of Patent: Mar. 9, 2021

(54) LOCKER WITH SOLID SURFACE PANELS HAVING EMBEDDED STRUCTURAL REINFORCING

(71) Applicant: Sam Allen, Maypearl, TX (US)

(72) Inventor: Sam Allen, Maypearl, TX (US)

( * ) Notice: Subject to any disclaimer, the term of this patent is extended or adjusted under 35 U.S.C. 154(b) by 0 days.

(21) Appl. No.: 16/549,528

(22) Filed: Aug. 23, 2019

(65) Prior Publication Data

US 2019/0374027 A1 Dec. 12, 2019

Related U.S. Application Data

(60) Provisional application No. 62/722,678, filed on Aug. 24, 2018.

(51) Int. Cl.
*A47B 47/02* (2006.01)
*A47B 87/00* (2006.01)

(52) U.S. Cl.
CPC ..... *A47B 47/02* (2013.01); *A47B 87/008* (2013.01)

(58) Field of Classification Search
CPC ..... A47B 7/02; A47B 87/008; A47B 87/00
See application file for complete search history.

(56) References Cited

U.S. PATENT DOCUMENTS 3,791,707 A * 2/1974 House ..... F16B 12/32 312/111
4,316,419 A * 2/1982 Cupido ..... B65D 19/0012 108/56.1
5,097,771 A * 3/1992 James, III ..... A47B 23/00 108/108
5,375,914 A * 12/1994 Donnelly ..... A47C 1/121 297/335
5,711,121 A * 1/1998 Garver ..... E04H 1/1266 16/251
5,857,742 A * 1/1999 Karl ..... A47C 1/124 297/188.13
5,976,670 A * 11/1999 Fugazzi ..... A47B 13/08 428/161
6,705,237 B2 * 3/2004 Moore, Jr. ..... B65D 19/0012 108/57.25
6,938,966 B1 * 9/2005 Rouwhorst ..... A47B 87/008 312/111
9,511,897 B2 * 12/2016 Liao ..... B65D 19/0026
9,669,962 B2 * 6/2017 Liao ..... B65D 19/0097
2003/0006520 A1 * 1/2003 Lin ..... B29C 41/22 264/73
2003/0079658 A1 * 5/2003 Torrey ..... B65D 19/0012 108/51.3
2004/0185213 A1 * 9/2004 Skelton ..... E05G 1/024 428/60
2006/0003155 A1 * 1/2006 Stewart ..... B32B 13/02 428/304.4

(Continued)

FOREIGN PATENT DOCUMENTS

GB 2262469 A * 6/1993 ..... B29C 70/70

*Primary Examiner* — Hanh V Tran
(74) *Attorney, Agent, or Firm* — James E. Walton

(57) ABSTRACT

A locker has walls made of a solid surface material. The walls include dado cuts and holes in which a web structured reinforcing member is embedded. The reinforcing members provide structural integrity to the walls of the locker. The reinforcing members are flush with the surfaces of the walls of the locker, thereby allowing adjacent lockers to be snugly secured to each other.

14 Claims, 1 Drawing Sheet

(56) References Cited

U.S. PATENT DOCUMENTS

| | | | | |
|---|---|---|---|---|
| 2007/0248836 | A1* | 10/2007 | Linde | B32B 5/16 428/522 |
| 2008/0119595 | A1* | 5/2008 | Waters | C09K 21/02 524/147 |
| 2009/0084055 | A1* | 4/2009 | Mangiardi | E04F 13/083 52/357 |
| 2009/0091229 | A1* | 4/2009 | Karl | A47C 19/025 312/351.1 |
| 2010/0237031 | A1* | 9/2010 | Kunis | A47B 61/06 211/86.01 |
| 2011/0025181 | A1* | 2/2011 | Vinke | A47B 67/04 312/257.1 |
| 2011/0047696 | A1* | 3/2011 | Szekely | A47C 5/12 5/400 |
| 2012/0192516 | A1* | 8/2012 | Hillers | E04B 1/14 52/309.4 |
| 2013/0061395 | A1* | 3/2013 | Karl | A47C 19/025 5/503.1 |
| 2013/0202367 | A1* | 8/2013 | Freitag | E02D 29/0241 405/284 |
| 2014/0230700 | A1* | 8/2014 | Hardikar | F16M 13/02 108/42 |
| 2016/0206156 | A1* | 7/2016 | Smith | A47K 3/40 |
| 2016/0258108 | A1* | 9/2016 | Jindra | D06F 60/00 |
| 2016/0332550 | A1* | 11/2016 | Stewart | A47B 5/04 |
| 2017/0314262 | A1* | 11/2017 | Kopish | E04B 2/7457 |
| 2018/0037011 | A1* | 2/2018 | Martorelli | B29C 44/58 |

* cited by examiner

LOCKER WITH SOLID SURFACE PANELS HAVING EMBEDDED STRUCTURAL REINFORCING

BACKGROUND

1. Field of the Invention

The present invention relates generally to improvements in lockers or storage cabinets used in athletic or sporting facilities, and more specifically to structural supports for such lockers.

2. Description of Related Art

The aesthetics and utility of lockers or storage cabinets in locker rooms of athletic and sporting facilities of sports teams and country clubs, for example, have become a measure of the quality and prestige of such organizations and an increasingly important aspect of recruiting new team or club members. Modern lockers are a far cry from the simple wood or metal cabinets of the past.

Modern lockers incorporate storage for specific items of equipment, such as helmets and shoes, and features promoting comfort and luxury. There is a constant need for improvement in both functional and aesthetic aspects of such lockers.

DESCRIPTION OF THE DRAWINGS

The novel features believed characteristic of the embodiments of the present application are set forth herein. However, the embodiments themselves, as well as a preferred mode of use, and further objectives and advantages thereof, will best be understood by reference to the following detailed description when read in conjunction with the accompanying drawings, wherein.

Figure 4:
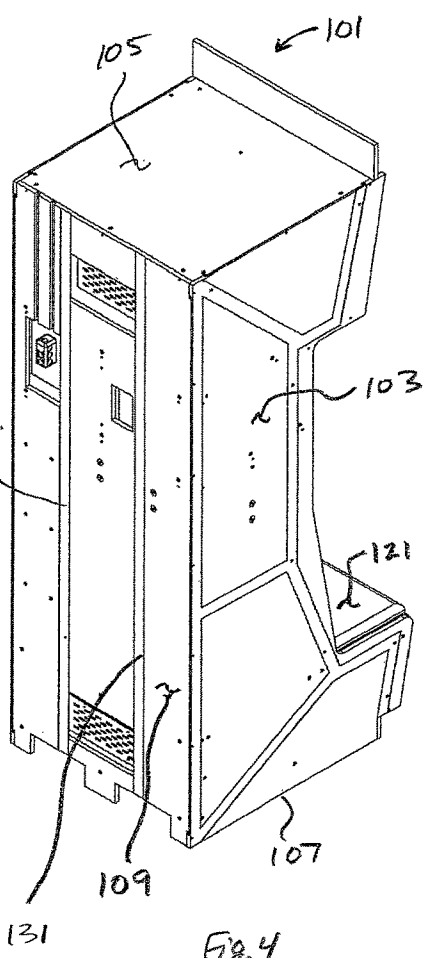
FIGS. 1 through 4 are various views of a locker with solid surface panels having embedded reinforcing members according to the present application.

While the assembly and method of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the locker seat assembly are provided below. It will of course be appreciated that in the development of any actual embodiment, numerous implementation-specific decisions will be made to achieve the developer's specific goals, such as compliance with assembly-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure 3:
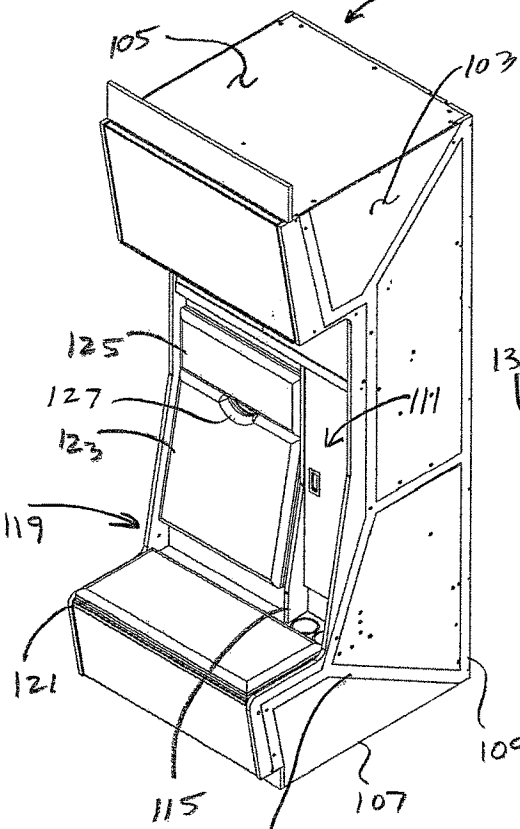
Figure 2:
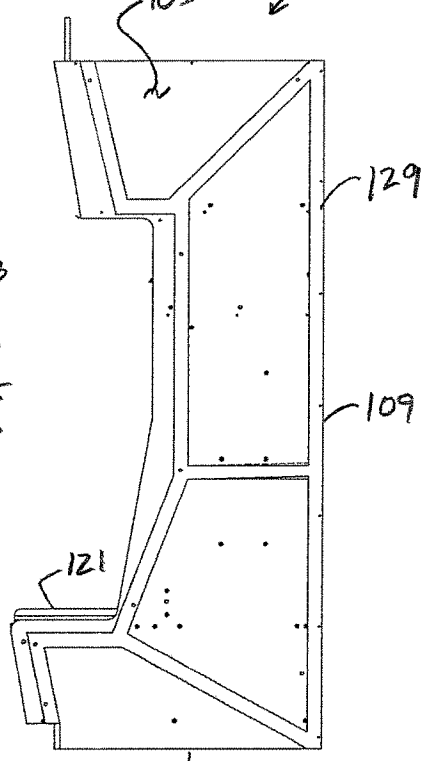
Figure 1:
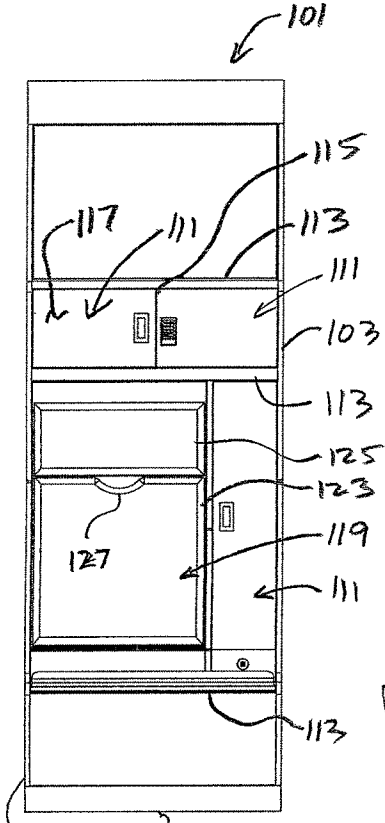

Referring now to FIGS. 1 through 4 in the drawings, the preferred embodiment of a locker 101 according to the present application is illustrated. The extent of locker 101 is generally defined by a pair of upstanding side walls 103, a top member 105, a bottom member 107, and a back wall 109. Each locker 101 may be installed adjacent to another similar or identical locker, with back walls 109 of each locker 101 facing either a wall structure or back wall 109 of an adjacent locker 101, with the front portion of locker 101 facing the interior of the locker room, so as to allow access to locker 101. Similarly, each locker 101 may be installed adjacent to another similar or identical locker, with one or both of side walls 103 of each locker 101 facing either a wall structure or the side wall 103 of an adjacent locker 101, with the front portion of locker 101 facing the interior of the locker room, so as to allow access to locker 101.

Between side walls 103 of each locker 101, one or more compartments 111 are defined by shelves 113 or other horizontally extending surfaces or platforms. Multiple dividers 115 may be placed between side walls 103 to define compartments 111 and the like. As used herein, "side wall" or "divider" may refer to either "main" sidewalls 103 or other interior side walls and/or dividers arranged between the side walls 103. Each compartment 111 may be sized and otherwise configured for storage of clothing or sporting equipment or other items, and may include a door 117, which may be lockable.

Locker 101 preferably incorporates a seat assembly 119 according to an embodiment of the present application. Each seat assembly 119 generally includes a generally horizontal portion or bench 121 and a seatback assembly 123, 125 according to the present application. Bench 121 and seatback 123, 125 may be disposed and extend between main side walls 103 or other sidewalls and/or dividers defined between main side walls 103. Bench 121 may extend at least partially forward of the front edges of side walls 103 and may be bordered by armrests or other structures raised above the sides of bench 121.

As is depicted, seatback assembly 123, 125 is preferably a two-piece assembly being formed by a back rest 123 and a head rest 125. Back rest 123 extends above and to the rear of horizontal bench 121 and is generally vertical, including slightly inclined to the rear, to support the back of the person sitting on bench 121. Head rest 125 is generally vertical. Back rest 123 and head rest 125 are each connected to side walls 103 of locker 101 by hinges at the upper and lower extents, respectively. Back rest 123 and head rest 125 are thus movable, independently of one another, about their respective hinges, between open and closed positions (the closed position being shown in the figures).

Bench 121 may be generally aligned with the front edges of side walls 103 between which bench 121 is disposed, or may project forward or be recessed. Bench 121, seat back 123, and head rest 125 are preferably padded and upholstered with an appropriate fabric, such as vinyl or leather, or a textile material.

Recesses 127 may be formed in the upper and/or lower edges of seat back 23 and/or head rest 125 to form an aperture to facilitate opening seat assembly 119. Recesses may be of varying configuration, curved or square/rectilinear, and may be provided in only one of seat back 123 or head rest 125, or not at all.

Side walls 103 and back wall 109 are preferably made of a material commonly known as "solid surface" material. Top member 105 and bottom member 107 may also be made of solid surface material, as well. Solid surface is a man-made material usually composed of polymer resins and the mineral filler alumina trihydrate (ATH), as well as pigments. Although solid surface material is quite versatile and desirable in many different applications, solid surface panels tend to be somewhat brittle, particularly in bending and when bolting two panels together. For example, if one were to use conventional solid surface materials and try to connect a side wall to a horizontal shelf, the structure would be very weak at point where the holes were drilled for the fasteners, due to the brittle nature of the solid surface material. This causes chipping, cracking, breaking, and stress concentrations when the fasteners are tightened, allowing the hardware to be ripped out or the threaded hole stripped out. As such, conventional solid surface panels materials have not been used as the material for building conventional lockers and locker panels, due to the high stress and rough treatment that lockers undergo in assembly and use.

However, according to the present application, side walls 103 and back wall 109 are formed from solid surface materials that have been modified by selectively placing dado cuts, holes, and other modifications to allow for custom tailored structural reinforcing members 129, 131 to be embedded therein. Side wall reinforcing members 129 and back wall reinforcing members 131 are each preferably formed from a single piece of steel, or other metallic material; however, it will be appreciated that reinforcing members 129, 131 may also be formed of multiple pieces. Reinforcing members 129, 131 fit in dado cuts made into side walls 103 and back wall 109, such that reinforcing members 129, 131 are preferably flush with or recessed within the corresponding surfaces of side walls 103 and back walls 109. This configuration ensures that adjacent lockers 101 fit snugly together and that reinforcing members 129, 131 are not exposed.

As is shown, reinforcing members 129, 131 preferably form "web structures" that span large portions of side walls 103 and back wall 109. This web structure distributes loads and stresses over a large portion of side walls 103 and back wall 109. More importantly, the shape and configuration of the web structure may be custom tailored to fit specific shelf configurations for different lockers. For example, the web structure may be designed to trace over where certain fasteners will be used to secure shelves and provide additional structural support for other components, such as shelves 113 and seat assembly 119. Adjacent lockers 101 may be secured together using fasteners passing through and/or coupled to reinforcing members 129, 131, thereby preventing cracking, breaking, and other damage. This unique hybrid solid surface material and steel reinforcing system results in a rigid, structurally sound locker, that is durable, has a long life, and is aesthetically pleasing.

Reinforcing members 129, 131 may also include interconnecting components, such as tabs, slots, notches, etc. that allow one locker to be releasably connected to an adjacent locker, without having to use fasteners. It will be appreciated that special side panels and special back panels, preferably made of matching solid surface material may be used to cover any side walls 103 or back walls 109 having exposed reinforcing members 129.

It is apparent that a system with significant advantages has been described and illustrated. The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description and claims. Although the present embodiments are shown above, they are not limited to just these embodiments, but are amenable to various changes and modifications without departing from the spirit thereof.

I claim:

1. A locker, comprising:

a pair of upstanding sidewalls; and a backwall;

wherein at least one of the sidewalls comprises:

a solid surface material having at least one recess; and an embedded web structure reinforcing member received within the at least one recess;

wherein the embedded web structure reinforcing member comprises a continuous structural strip spanning height, width, and diagonal dimensions of the at least one of the sidewalls defining void areas; and wherein the embedded web structure reinforcing member is within an external surface of the solid surface material, such that an external surface of the embedded web structure reinforcing member is exposed for a connection to be made to the embedded web structure reinforcing member for connecting the locker to an adjacent locker.

2. The locker of claim 1, wherein the embedded web structure reinforcing member comprises:

multiple pieces of metallic material.

3. The locker of claim 1, wherein the embedded web structure reinforcing member comprises:

a single piece of metallic material.

4. The locker of claim 1, wherein the external surface of the embedded web structure reinforcing member is flush with the external surface of the solid surface material.

5. The locker of claim 1, wherein the embedded web structure reinforcing member is recessed within the solid surface material.

6. The locker of claim 1, wherein the locker is releasably connected to an adjacent locker.

7. The locker of claim 6, wherein the locker and adjacent locker are releasably connected using at least one fastener passing through the embedded web structure reinforcing member.

8. The locker of claim 6, wherein the embedded web structure reinforcing member is not exposed between the lockers.

9. The locker of claim 1, wherein the locker is releasably connected to multiple adjacent lockers.

10. The locker of claim 1, wherein the backwall comprises:

a solid surface material; and an embedded web structure reinforcing member;

wherein the embedded web structure reinforcing member is recessed within an external surface of the solid surface material, such that an external surface of the embedded web structure reinforcing member is exposed.

11. A method for constructing a locker, comprising:

providing a pair of upstanding side walls each being formed of one or more solid surface materials;

providing a back wall being formed of one or more solid surface materials;

connecting the sidewalls to the back wall;

modifying at least one of the side walls by adding at least one recess therein; and embedding at least one web reinforcing member in the at least one recess;

wherein embedding the at least one web reinforcing member comprises embedding a continuous structural strip that spans height, width, and diagonal dimensions of the at least one of the side walls defining void areas; and wherein the at least one web reinforcing member is within an external surface of the solid surface material, such that an external surface of the embedded web structure reinforcing member is exposed for a connection to be made to the embedded web structure reinforcing member for connecting the locker to an adjacent locker.

12. The method according to claim 11, further comprising:

connecting the locker to at least one adjacent locker.

13. A method for constructing a locker, comprising:

providing a pair of upstanding sidewalls each being formed of one or more solid surface materials;

providing a back wall being formed of one or more solid surface materials;

connecting the sidewalls to the back wall;

modifying at least one of the sidewalls or the back wall by adding at least one recess therein and attaching at least one web reinforcing member to the at least one recess of the at least one of the sidewalls or the back wall;

wherein the at least one web reinforcing member comprises a continuous structural strip that spans height, width, and diagonal dimensions of the at least one of the side walls or the back wall defining void areas; and wherein the at least one web reinforcing member is within an external surface of the solid surface material, such that an external surface of the embedded web structure reinforcing member is exposed for a connection to be made to the embedded web structure reinforcing member for connecting the locker to an adjacent locker.

14. The method according to claim 13, further comprising:

connecting the locker to at least one adjacent locker.

* * * * *